United States Patent [19]

Creedon

[11] Patent Number: 4,774,872

[45] Date of Patent: Oct. 4, 1988

[54] PRESTRESSED TUBE AND TUBE JOINT

[75] Inventor: Richard L. Creedon, San Diego, Calif.

[73] Assignee: GA Technologies Inc., San Diego, Calif.

[21] Appl. No.: 818,203

[22] Filed: Jan. 13, 1986

Related U.S. Application Data

[63] Continuation-in-part of Ser. No. 506,430, Jun. 21, 1983, Pat. No. 4,624,173, and a continuation-in-part of Ser. No. 711,236, Mar. 13, 1985, abandoned.

[51] Int. Cl.[4] ..... F41F 1/02; F16L 17/00; F04F 1/08

[52] U.S. Cl. ..... 89/8; 89/15; 89/16; 138/153; 138/155; 138/172; 285/96; 285/100; 285/384; 403/5; 403/15

[58] Field of Search ..... 89/8, 15, 16, 14.1, 89/14.05; 42/76 R, 76 A; 124/3; 285/18, 55, 95, 96, 100, 384, 385, 406, 96; 403/15, 11, 5, 265, 266, 342; 138/172, 174, 153, 140, 155; 310/11-14

[56] References Cited

U.S. PATENT DOCUMENTS

| | | | |
|---|---|---|---|
| 473,462 | 4/1892 | Hogan | 285/384 |
| 1,186,813 | 6/1916 | McFerran | 285/384 X |
| 1,320,110 | 10/1919 | Aydukovich | 89/8 |
| 1,421,435 | 7/1922 | Fauchon-Villeplee | 89/8 X |
| 3,228,298 | 1/1966 | Grandy et al. | 89/16 |
| 3,713,204 | 1/1973 | Arnold | 285/96 X |
| 4,264,229 | 4/1981 | Falk et al. | 403/15 X |
| 4,341,484 | 7/1982 | Peterson et al. | 403/5 |
| 4,424,734 | 1/1984 | Janssen et al. | 89/16 |
| 4,425,050 | 1/1984 | Durand | 403/15 |
| 4,549,581 | 10/1985 | Unno et al. | 138/174 X |

*Primary Examiner*—Deborah L. Kyle
*Assistant Examiner*—John E. Griffiths
*Attorney, Agent, or Firm*—Fitch, Even, Tabin & Flannery

[57] ABSTRACT

A joint is provided for joining together two sections of a tube wherein the sections are prestressed by a surrounding pressure medium to press the sections together and to resist forces tending to separate the sections and the bursting pressure inside the tube. The pressure medium can be a resin which can be pressurized and subsequently cured or a fluid. The outside diameter of each section, at and near the end to be joined, is enlarged. A coupling means encircles the enlarged portions and couples the two sections together. One or more expandable pressure cavities located within said coupling means and/or within the enlarged portions have the general shape of a flared annuli. The pressure medium fills and expands the pressure cavities and, when pressurized, exerts stresses compressing both sections together at the joint and also applies relatively uniform radial stress in the vicinity of the end of each section.

8 Claims, 2 Drawing Sheets

FIG. 5
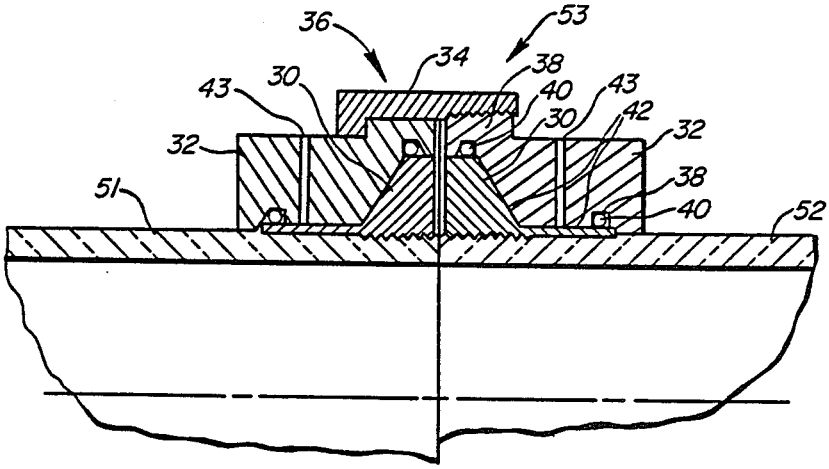
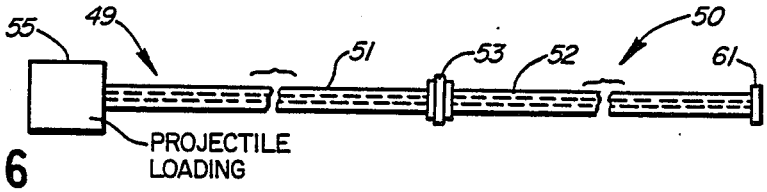
FIG. 6
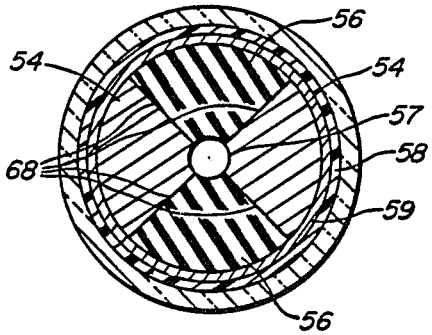
FIG. 7

PRESTRESSED TUBE AND TUBE JOINT

This application is a continuation-in-part of U.S. patent application Ser. No. 506,430, filed June 21, 1983, U.S. Pat. No. 4,624,173 and U.S. patent application Ser. No. 711,236 filed Mar. 13, 1985, now abandoned.

This invention relates to prestressed tubes and tube joints and especially to such prestressed tubes and tube joints as are used in the manufacture of rail gun barrels.

BACKGROUND OF THE INVENTION

A need exists for lightweight tubes capable of withstanding large bursting forces. There also exists a need for a lightweight joint which can be used to join together two sections of such a tube. Current designs for joining tubes typically result in the application of widely varying stresses on the ends of the sections being joined. One of the possible uses of such tubes and joints is for rail guns.

In a rail gun, it is desirable that the rails and the adjacent insulating members fit together with very close tolerances and be tightly constrained against displacement outward. A typical, known rail gun barrel assembly employs a large number of bolts to clamp stiff structural members about the barrel components to react bursting forces. In some proposed designs the length of the rail gun barrel exceeds 90 feet. Manufacture and transport of such rail gun barrels would be greatly simplified if they could be manufactured and transported in sections and the sections joined at the site of use. Designs have been proposed for using large numbers of bolts and clamps to connect two sections of a rail gun to form a joint.

SUMMARY OF THE INVENTION

In accordance with the present invention, a joint is provided for joining together two sections of a tube wherein the sections are prestressed by a surrounding pressure medium to press the sections together and to resist forces tending to separate the sections and the bursting pressure inside the tube. The pressure medium can be a resin which can be pressurized and subsequently cured or a fluid. The outside diameter of each section, at and near the end to be joined, is enlarged. A coupling means encircles the enlarged portions and couples the two sections together. One or more pressure cavities located within said coupling means and/or within the enlarged portions have the general shape of a flared annuli. The pressure medium fills the pressure cavities and, when pressurized, exerts stresses compressing both sections together at the joint and also applies relatively uniform radial stress in the vicinity of the end of each section.

BRIEF DESCRIPTION OF THE DRAWINGS

FIG. 5 is a partial sectional view of the two tube sections and a joint joining the two sections in accordance with another embodiment of this invention.

FIG. 6 is a diagrammatic side elevation view of a rail gun barrel assembly in accordance with one embodiment of this invention.

FIG. 7 is a transverse section view of a rail gun barrel assembly in accordance with one embodiment of this invention.

DESCRIPTION OF THE PREFERRED EMBODIMENTS

One preferred embodiment of the present invention can be described by reference to FIGS. 1, 2, and 3.

Figure 1:
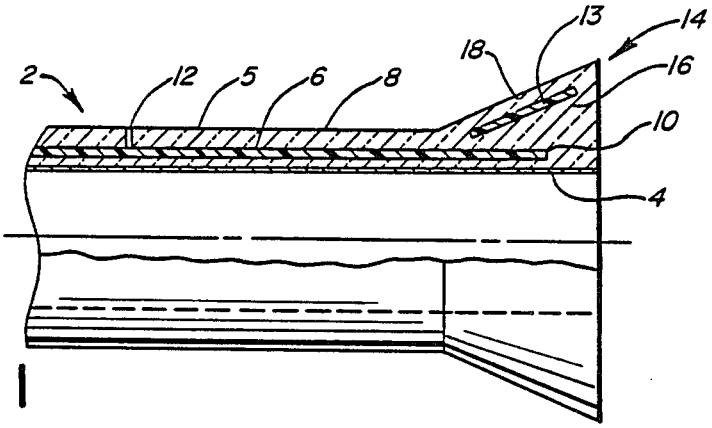
FIG. 1 is an elevation view of a portion of a tube with a portion broken away showing features of one embodiment of the present invention.
Figure 2:
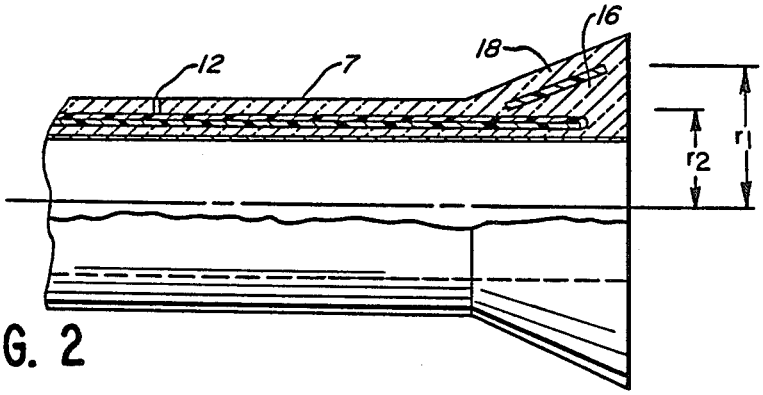
FIG. 2 is an elevation view of a portion of a tube with a portion broken away showing additional features of one embodiment of the present invention.

One end of a section of a filament wound tube 2 is shown in FIG. 1. The top half is shown in section. The filaments are wound on a thin walled inner shell 4 having an outer radius of about 2 cm. Layers of filaments of glass at a 70% packing density in an epoxy matrix form an inner filament layer 5 having a thickness of about 3 mm. A non-adhering lamina 6 such as a Teflon film or waxed paper is laid over the inner layer 5 and additional layers of filaments of glass, as described above, are wound over the non-adhering lamina to form an outer filament layer 8. The non-adhering lamina 6 extends to a point 10 approximately 2 cm short of the ends of the tube so that the non-adhering lamina layer 6 is completely enclosed by the inner filament layer 5 and the outer filament layer 8.

A small diameter hole 12 is drilled in the main body of the tube to the non-adhering lamina. Resin is injected under pressure which causes an annular split to develop along the lamina 6 to create a lamina space 7, and the pressure crushes inner filament layer 5 against inner shell 4. The resin may be injected on either the inside or outside or both sides of lamina 6. The pressure prestresses the tube to constrain it against bursting pressures. The resin is then cured. It is important to use a resin which does not appreciably decrease in volume when it is cured to the solid phase. For example a 1% shrinkage could normally be tolerated and in some cases resins which shrink as much as 5% could be used. It is desirable to install a temporary reinforcement around the end of the tube during injection to prevent splitting at the end 10 of the lamina 6. This reinforcement can be removed when the resin has set. After the resin has set, removal of the reinforcement will cause the tube to split for an extremely short distance, i.e., beyond point 10; but the resin, being in solid form, would not be able to move into the newly split portion to propogate the split further.

This embodiment is designed so that two sections of the tube may be joined together. Beginning at about three centimeters from the end to be joined, the outer layers of filament are built up to a flare 14 in which the inner diameter of the tube is uniform, while the outer diameter increases toward the end of the tube. However, a non-adhering lamina 13 is laid down between an inner flare 16 and an outer flare 18 in the same manner as described above. As shown in FIGS. 1 and 2, the lamina 13 is generally frustoconical or shaped like a flared annulus with the inside radius $r_1$ of the layer near the end of the tube being greater than the inside radius $r_2$ of the layer further from the end.

Figure 3:
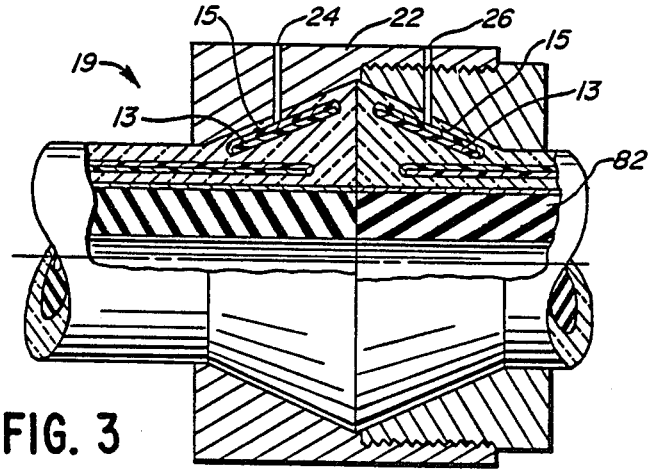
FIG. 3 is an elevation view of a sleeve assembly portion of two rail gun sections with portions broken away; the sections are shown joined together in accordance with one embodiment of the present invention.

FIG. 3 shows a joint of two tube sections constructed as described above. A sleeve assembly 19 is fitted over the flared ends of the two sections to be joined. In this embodiment the sleeve assembly consists of an inner sleeve element 20 and sleeve nut 22. Elements 20 and 22 comprise wrench grips so that they can be torqued together to compress the faces of the tube section together with an appropriate force in the range of a few hundred psi.

Small diameter holes 24 and 26 are drilled through the sleeve assembly into the flared portions of the tube sections so as to extend to the lamina of those sections 13. As described above, pressure in the form of resin is applied at lamina 13 of each tube section, on either or both sides thereof, to cause a split along the lamina surfaces to create pressurized lamina spaces 15 along the lamina layers 13 which prestresses the end portions of the tube sections. The pressure in the lamina space also increases the pressure of the end faces of both sections against each other. Since the lamina space is at an angle in this embodiment of about 30° with the tube axis, the axial component of the force in the lamina is about 50% of the primary force. Similarly, the radial component is about 86% of the primary force. In this preferred embodiment it has been determined that pressurization of the lamina space with approximately 5,000 psi can provide more than enough compressive pressure on the faces of the two sections.

Preferably, the lamina space should be designed to impose the proper forces axially, to compress the two ends together, and radially, to resist the radial bursting forces. By increasing the angle between the tube axis and a line joining the end points of the frustoconical lamina space 15, a greater portion of the pressure exerted by the pressure medium in the lamina space 15 will go to compressing the two sections together.

Figure 4:
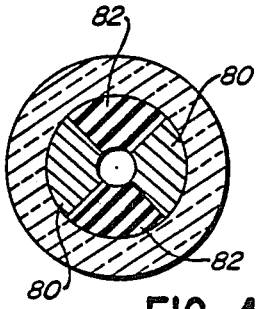
FIG. 4 is a transverse sectional view showing the location of the rails in the rail gun sections shown in FIG. 3.

Referring now to FIG. 4, the embodiment described above is particularly suitable for use in the construction of long lightweight rail gun barrels. For such use, the above-described thin walled inner shell 4 would be shrink-fitted around two rails 80 and the two insulator members 82 illustrated in FIG. 4 prior to winding the filament layers. For this application, the inner shell 4 preferably comprises a relatively flexible sleeve.

In one preferred embodiment, the inner shell 4 in FIG. 1 is replaced by a mandrel which is removed and replaced with the rails 54 and insulator members 56 prior to pressurizing the lamina space. In this embodiment, the inner filament layer 5 is collapsed against inner sheet 4 rails 54 and insulator members 56. Further details concerning the construction and operation of the rail gun, and the nature of the bursting forces encountered during operation thereof, are given below.

FIG. 5 illustrates another preferred embodiment of this invention. In this embodiment, pistons 30 are screwed onto ends of tubular barrel sections 51 and 52 to simulate flared ends use in joining the tube sections. Sleeve element 32 and sleeve nut 34 are screwed together to form sleeve assembly 36 which compresses the two barrel ends together. "O" ring slots 38 in sleeve element 32 provide a space for rubber "O" rings 40. These "O" rings form the boundary for pressure cavity 42. As in the first embodiment, small diameter holes 43 are drilled in sleeve element 32 through which pressure cavity 42 is filled with a pressure medium to stress the components of the joint in both the axial direction to hold the ends together under compression and in the radial direction to counteract the radial bursting forces in the tube.

Referring to FIGS. 6 and 7, there is shown a rail gun assembly 49 comprising a barrel 50 comprised of two sections 51 and 52 joined by joint 53. Sections 51 and 52 each include a pair of elongated, generally parallel, conductive rails 54 and a pair of elongated, generally parallel, insulating members 56 disposed circumferentially between the rails 54.

The rails 54 are disposed symmetrically about the longitudinal axis of the barrel, as are the insulating members 56. The rails 54 may be made of a copper alloy or other conducting material and are electrically connected at their respective rearward or breech ends to opposite terminals of a source of direct current (not shown). Means 55 for loading projectiles into the barrel are provided at the breech end. The rails may have longitudinal passages (not shown) formed in them for coolant flow.

The rails 54 and insulating members 56 herein define a generally cylindrical bore 57 through which the projectile (not shown) travels. The bore 57 may be of circular cross section, as shown, or may alternatively be of rectangular or other suitable cross section.

A circuit through the rails may be completed either by a conductor or a plasma arc disposed between the rails. Where a plasma arc is used, high fluid pressures are generated within the barrel by the arc heating the plasma material. This material is initially in the form of a fuse on the projectile rear end. As current flows through the circuit, magnetic flux is generated between the rails. The magnetic flux cooperates with the current in the conductor or plasma arc to accelerate the conductor or plasma forward between the rails. The projectile may include the conductor or may be positioned forward of the conductor or plasma arc and driven forward thereby. The rails 54 are constrained against radially outward displacement and are preloaded by a pressure medium in pressure cavity 58. An inner shell 59, a lightweight, relatively rigid outer shell 60, and end sealing means 61 contain the pressure medium. The pressure medium in pressure cavity 58 applies approximately uniform radial compression forces to the peripheral surfaces of the rails 54 and insulating members 56, respectively, and applies relatively evenly distributed radial stresses to the outer shell 60. The pressure medium is pressurized prior to firing of the gun.

As stated above, high fluid pressure or gas pressure may be generated within the bore during firing due to the plasma arc. This pressure, in combination with the electromagnetic forces generated on the rails during firing, tends to push the rails 54 and insulating members 56 apart. If the rails and insulating members are constrained adequately, the stresses experienced by the inner portions of the rails 54 and insulating members 56 adjacent the bore are distributed over relatively large peripheral surfaces and transmitted to the outer shell 60. If the rails and insulating members move outward during firing, high pressure gases within the bore may leak through the interfaces 68 between the rails 54 and insulating members 56, and cause the outer shell 60 to burst. In accordance with the present invention, the pressure medium in a pressure cavity 58 supplies preload to the rails and insulating members sufficient to effectively seal the interfaces 68 from high pressure gas.

The pressure medium may be a fluid such as air, water or oil, or in the alternative may be a resin which is pressurized as a liquid and subsequently cured. When this invention is used to hold in place rail gun components, inner shell 59 should be a relatively flexible sleeve or membrane which fits over the rails 54 and insulating members 56 to prevent the pressure medium 58 from leaking into the interfaces 68 between the rails 54 and insulating members 56. Any suitable external pressurizing means (not shown) may be employed to bring the pressure medium to the desired pressure.

Where the pressure medium 58 is a gas or a fluid such as water or oil, it is maintained at a desired pressure during firing of the gun, but may be subsequently permitted to return to a lower pressure. Where the pressure medium is a resin, the resin is cured prior to use of the barrel 50 to set it at a predetermined pressure.

Use of a fluid such as a gas, water or oil facilitates removal of the rails 54 for maintenance in that it enables the pressure on the rails to be removed simply by reducing the pressure in the fluid. Use of a resin, on the other hand, provides a different advantage in that once the resin is cured, maintenance of pressure no longer requires maintenance of seals about the pressure medium in cavity 58. This may simplify assembly of the barrel and may permit the use of barrel configurations which would not be feasible with a fluid such as oil or water.

For purposes of clarity of illustration, the cross-sectional area of the pressure cavity 58 is disproportionately illustrated in the drawings. It may actually be a layer having a relative thickness much less than that shown. The thickness of this layer may be, for example, on the order of 0.5 mm.

The outer shell 60 is preferably made of a non-metallic material. For example, it may be composed of woven silicon carbide fibers disposed within a resin, or may be composed of a glass composite material.

While the preferred embodiments have been illustrated and described herein, there is no intent to limit the scope of the invention to those or any other particular embodiments.

What is claimed is:

1. A multiple section rail gun barrel, comprising:

a first barrel section including an outer wall with an enlarged end having a mating face;

a second barrel section including an outer wall with an enlarged end having a mating face to be joined to the enlarged end of the first barrel section at the mating face thereof, said enlarged end of said second barrel section being outwardly flared so as to open toward the mating face thereof and defining an interior expandable cavity for receiving a pressurized medium;

collar means disposed about said enlarged ends of said first and said second barrel sections and having a portion proximate said internal cavity of said second barrel section so as to support said enlarged end of said second barrel section against outward swelling when a pressurized medium is introduced into said internal cavity; and means for introducing a pressurized medium into said cavity so as to cooperate with said cavity and said collar means to generate a pressure force in an axial direction toward the mating face of the first barrel section to bring said first and said second barrel sections into compressive sealing engagement at the mating faces thereof.

2. The rail gun barrel of claim 1 wherein said second barrel section comprises a filament layer including filaments wound in the shape of a tube having a central axis and an enlarged end; and a non-adhering lamina in the windings of said filament layer at the end portion thereof, said non-adhering lamina having a configuration substantially that of an annulus outwardly flared so as to open toward the mating edge of said enlarged end, said non-adhering lamina separable from adjacent filament layers so as to form said cavity when a pressurized medium is introduced into the region of said enlarged end where said non-adhering lamina adjoins said windings of said filament layer.

3. The rail gun barrel of claim 2 wherein said means for introducing a pressurized medium include aperture means defined by portions of said filament layer surrounding said non-adhering lamina, through which said pressurized medium is introduced between said non-adhering lamina and layers of said filament adjacent thereto.

4. The rail gun barrel of claim 2 wherein said enlarged end of the outer wall of said first barrel section is outwardly flared so as to open toward the mating face thereof and defines an interior, expandable cavity for receiving a pressurized medium;

said collar means includes another portion proximate said internal cavity of said first barrel section so as to support the enlarged end said first barrel section against outward swelling when a pressurized medium is introduced into the internal cavity of said first barrel section; and said rail gun barrel includes means for introducing a pressurized medium into the cavity of said first barrel section so as to cooperate with said cavity of said first barrel section and collar means to generate a pressure force in an axial direction toward the mating of the second barrel section so as to aid in bringing said first and said second barrel sections into compressive sealing engagement at the mating faces thereof.

5. The rail gun barrel of claim 4 wherein the outer walls of said first and said second barrel sections each define internal, generally longitudinally-extending cavities;

means for introducing a pressurized medium into the generally longitudinally-extending cavities of said first and said second barrel sections; and said cavities of said first and said second barrel sections being expandable upon the introduction of a pressurized medium therein so as to generate internally-directed compressive forces for resisting bursting pressures internal to said barrel sections.

6. The rail gun barrel of claim 5 wherein the outer walls of said first and said second barrel sections comprise filament layers including filaments wound in the shape of a tube having a central axis; and a non-adhering lamina in the windings of said filament layer, said non-adhering lamina having a generally tubular configuration and being separable from adjacent filament layers so as to form said generally longitudinally-extending cavity when a pressurized medium is introduced into the region of said outer walls where said non-adhering lamina adjoins said windings of said tubular filament layer.

7. The rail gun barrel of claim 6 wherein said means for introducing a pressurized medium include aperture means defined by portions of said tubular filament layer surrounding said non-adhering lamina, through which said pressurized medium is introduced between said non-adhering lamina and layers of said filament adjacent thereto.

8. Prestressed tube and tube joint comprising:

(a) two tube sections each section comprising:

an inner filament layer comprised of filaments wound in the shape of a tube having a central axis, a non-adhering tube lamina laid over said inner filament layer concentric with the central axis of said inner filament layer but not covering said inner filament layer at its ends, an outer filament layer comprised of filaments wound over said non-ahdering layer and said inner filament layer at its ends so as to enclose said non-adhering tube lamina between said outer and inner filament layers and to define a first expandable pressure cavity containing said non-adhering tube lamina, said outer filament layer being enlarged in diameter by additional filament windings on at least one end to form at least one or two enlarged end portion, a non-adhering end lamina laid in and enclosed by at least one enlarged end portion, said lamina having the general shape of annulus, having a small diameter and a larger diameter, said larger diameter being farther from the mid-point of said tube section than said smaller diameter, said encircled lamina layers defining second expandable pressure cavities, (b) coupling means encircling said enlarged portion of each of two sections to couple together said two tube sections, (c) a first pressure medium disposed in said first pressure cavity of each section and a second pressure medium disposed in said second pressure cavities, said first pressure medium and said second pressure medium being a member of a group consisting of a resin which is pressurized as a liquid and subsequently cured and a fluid, (d) said first pressure medium being under pressure so as to expand said first pressure cavity and to apply compressive force radially inwardly, (e) said second pressure medium being under pressure so as to expand said second pressure cavity and to apply compressive force at the faces of said sections being joined and also radially inwardly.

* * * * *